US005144368A

United States Patent [19]

Ohzeki et al.

[11] Patent Number: 5,144,368

[45] Date of Patent: Sep. 1, 1992

[54] CHARGING DEVICE AND IMAGE FORMING APPARATUS HAVING SAME

[75] Inventors: Yukihiro Ohzeki; Junji Araya; Tatsunori Ishiyama, all of Yokohama, Japan

[73] Assignee: Canon Kabushki Kaisha, Tokyo, Japan

[21] Appl. No.: 611,643

[22] Filed: Nov. 13, 1990

[30] Foreign Application Priority Data

Nov. 15, 1989 [JP] Japan ..... 1-294820

[51] Int. Cl.[5] ..... G03G 15/02

[52] U.S. Cl. ..... 355/219; 355/271; 355/274; 355/276

[58] Field of Search ..... 355/219, 222, 223, 271, 355/274, 276, 203, 208; 361/225, 221

[56] References Cited

U.S. PATENT DOCUMENTS

| | | | |
|---|---|---|---|
| 4,727,453 | 2/1988 | Ewing | 355/219 X |
| 4,851,960 | 7/1989 | Nakamura et al. | 361/225 |
| 4,959,688 | 9/1990 | Koitabashi | 355/219 |
| 5,006,902 | 4/1991 | Araya | 355/219 X |
| 5,034,777 | 7/1991 | Ohzeki et al. | 355/274 |

FOREIGN PATENT DOCUMENTS

| | | | |
|---|---|---|---|
| 0272072 | 6/1988 | European Pat. Off. | 355/219 |
| 0280542 | 8/1988 | European Pat. Off. | 355/219 |
| 0308185 | 3/1989 | European Pat. Off. | 355/219 |
| 0330820 | 9/1989 | European Pat. Off. | 355/219 |
| 0367245 | 5/1990 | European Pat. Off. . | |
| 0132356 | 10/1981 | Japan | 355/219 |
| 0267667 | 10/1989 | Japan | 355/219 |

*Primary Examiner*—A. T. Grimley
*Assistant Examiner*—William J. Royer
*Attorney, Agent, or Firm*—Fitzpatrick, Cella, Harper & Scinto

[57] ABSTRACT

A charging device includes a contact member contactable to a member to be charged; and a voltage applying device for applying to the contact member a voltage having a level which periodically changes, to charge the member to be charged; wherein the voltage applying device constant-voltage-controls the contact member in a first period and constant-current-controls the contact member in a second period, wherein a voltage level in the first period is determined in the second period.

65 Claims, 6 Drawing Sheets

CHARGING DEVICE AND IMAGE FORMING APPARATUS HAVING SAME

FIELD OF THE INVENTION AND RELATED ART

The present invention relates to a charging device and an image forming apparatus such as an electrophotographic copying machine or an electrographic printer, having the same, more particularly to a charging device having a member contactable to a member to be charged such as an image bearing member and an image forming apparatus having the same.

In a type of electrophotographic copying machine, a surface of an image bearing member such as a photosensitive member is uniformly charged and is exposed to an image signal by a laser beam or the like modulated in accordance with the image, so that an electrostatic latent image is formed. Thereafter, the latent image is developed with toner into a toner image. The toner image is then transferred onto a transfer material. As for the means for uniformly charging the surface of the image bearing member, there is a contact type charging member such as an elastic charging roller or a charging valve contactable to the image bearing member, the charging member being supplied with a bias voltage.

The contactable type charging means is advantageous over a corona charger which is well-known in the field of the image forming apparatus, in that the applied voltage is as low as 1-2 KV (4-8 KV in the corona charger), that the device is therefore simple, that the charging efficiency is high, that the ozone or NOx are not produced, that the contamination inside the apparatus and the deterioration of the image attributable to such productions can be avoided, that the non-uniforming charging attributable to the contamination of the discharging wire can be minimized. Therefore, the contact type charging means becomes noteworthy.

U.S. Pat. No. 4,851,960, for example, discloses such a contact type charging means wherein a vibratory voltage is applied between the charging member and the image bearing member (the member to be charged), the vibratory voltage having a peak-to-peak voltage which is not less than twice the charge starting voltage upon application of a DC voltage to said charging member, by which the potential on the charged surface has a uniform potential. U.S. Ser. No. 753,027 discloses that a high resistance layer is formed on the surface of the charging member to prevent production of a pin hole in the surface of the image bearing member or to prevent damage of the image bearing member surface.

However, if the high resistance layer is formed on the surface of the charging member, the high resistance layer is easily influenced by the ambient condition, particularly the humidity. More particularly, under the low humidity condition, the resistance increases, and therefore, the dielectric constant decreases with the result of the increase of the impedance of the charging member. Under the high humidity condition, on the contrary, the resistance decreases, and therefore, the dielectric constant increases with the result of the decrease of the impedance of the charging member.

It follows that under the low humidity condition, the AC component of the voltage applied between the charging member and the image bearing member attenuates by the impedance of the charging member, possible to such an extent that the vibratory electric field is insufficient even if the voltage having the peak-to-peak voltage not less than twice the charge starting voltage is applied between the charging member and the image bearing member. If this occurs, the charging operation is not improper, that is, non-uniform with dots. Taking into account the attenuation of the AC component by the increased impedance of the charging member under the low humidity condition, it is possible to apply an AC voltage having a high peak-to-peak voltage to the charging member so that the sufficient vibratory electric field is formed even under the low humidity conditions.

However, under a high humidity condition involving the decreased impedance of the charging member, the AC component is not attenuated by the charging member, and the high voltage is directly applied to the image bearing member. Under the high humidity condition, the voltage resistivity of the material generally decreases. Therefore, it is disadvantageous from the standpoint of current leakage prevention in the image bearing member and/or the charging member.

U.S. Ser. No. 752,974 which has been assigned to the assignee of this application as with the above-mentioned U.S. Patent and U.S. Application, proposes that an AC voltage applied to the charging member is constant-current-controlled in order to provide uniform and stabilized charging at all times against variation in the ambient conditions. If, however, the image bearing member has a large pin hole in an image area, the current flows concentratedly through the pin hole, with the result of attenuation of the voltage between the charging member and the image bearing member, and therefore, insufficient charged potential level of the image bearing member.

SUMMARY OF THE INVENTION

Accordingly, it is a principal object of the present invention to provide a charging device and an image forming apparatus having the same wherein a surface to be charged is uniformly charged stably at all times against variation in the change of the ambient condition.

It is another object of the present invention to provide a charging device and an image forming apparatus having the same, wherein a member to be charged is prevented from being damaged.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Figure 8:
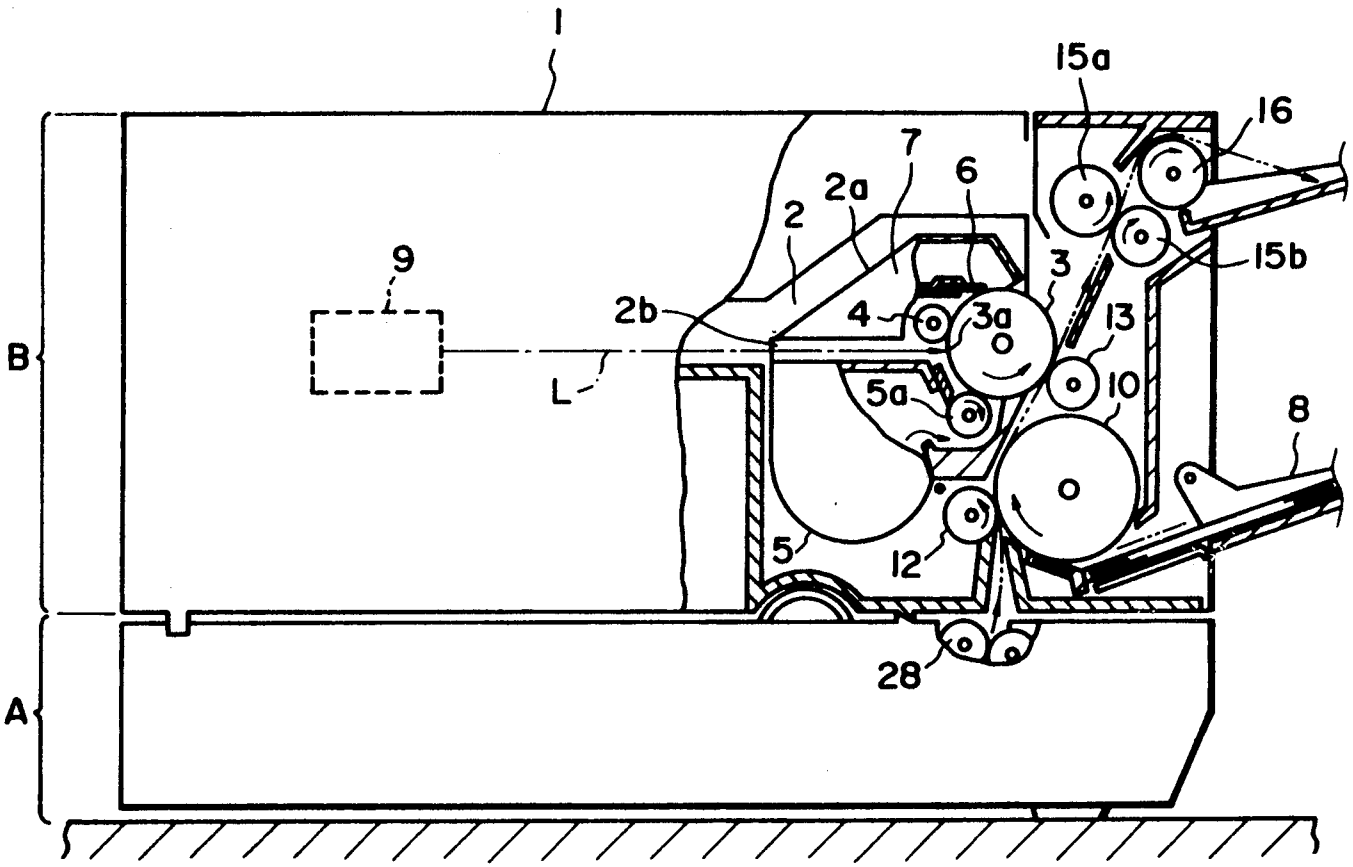
FIG. 8 is a side view of an image forming apparatus according to an embodiment of the present invention.

Referring first to FIG. 8, there is shown an image forming apparatus to which the present invention is applicable. It comprises an image bearing member in the form of a photosensitive member, a charging roller, a developing device and a cleaner disposed around the image bearing member. They are constituted into a unit in the form of a cartridge 7. The cartridge 7 is detachably mountable into the main assembly 2 of the image forming apparatus 1 and may contain at least the image bearing member and a charging device including the charging roller, in this embodiment.

When the photosensitive member 3 rotates about its axis in the direction indicated by an arrow, a laser beam L modulated in accordance with the image to be recorded is supplied from a laser beam scanner 9 onto the surface of the photosensitive member 3 at an exposure station 3*a* through an optical path 2*b* between the cleaner 2*a* and the developing device 5. The beam L scans the photosensitive member 3 in a direction of its axis (perpendicular to the sheet of the drawing). Before that, the surface of the photosensitive member 3 is uniformly charged to a predetermined polarity by the charging roller 4 which is a contact type charging member and is contacted to the photosensitive member 3. Therefore, an electrostatic latent image is formed on the charged surface of the photosensitive member 3 by the laser beam L. When the latent image reaches a developing position where the developing device 5 is faced to the photosensitive member 3 by the rotation of the photosensitive member 3 in the direction indicated by the arrow, the toner is supplied to the latent image from the developing device 5 so that a toner image is formed. In the developing device 5, a thin layer of the toner is formed on a developing sleeve 5*a* supplied with a developing bias.

When the toner image reaches an image transfer station where the transfer roller 13 is contacted or faced to the photosensitive member 3 the toner image is transferred from the photosensitive member 3 to a transfer material by the transfer bias applied to the transfer roller 13. The transfer material is supplied from a transfer material container (tray) 8 by a pick-up roller 10 and a conveying roller 12 press-contacted thereto in timed relation with the toner image on the photosensitive member to the transfer station. The path of the transfer material is indicated by a chain line.

The transfer material carrying the toner image is passed through the image fixing device having a pair of rollers 15*a* and 15*b*, by which the toner image is fixed on the transfer material and is discharged to the outside of the apparatus by the discharging roller 16.

The toner remaining on the photosensitive member 3 without being transferred onto the transfer material during the transfer action, reaches the cleaner 2 by the rotation of the photosensitive member 3, and is removed by the cleaning blade 6, so that the photosensitive member 3 is prepared for the next image forming process operation.

The apparatus shown is equipped with registration roller couple 28 for supplying the transfer material to the transfer station from a cassette in the transfer material container 8, the description thereof is omitted since it is not of significance in the present invention.

Figure 1:
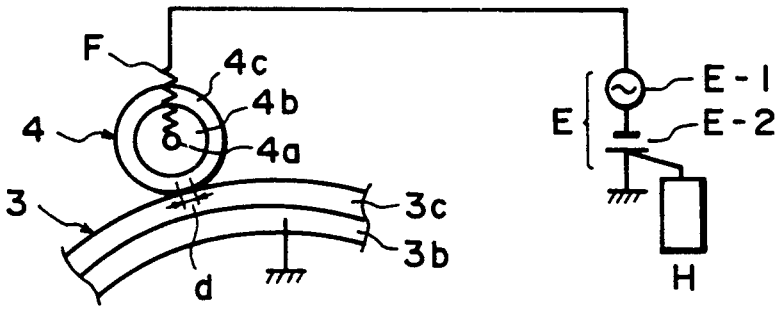
FIG. 1 is a side view illustrating a major part of a charging device according to an embodiment of the present invention.

FIG. 1 is an enlarged view around the charging station of FIG. 8. The photosensitive member 3 (the member to be charged) has a grounded aluminum base 3*b* and a photosensitive layer 3*c* of an organic photoconductor having a thickness of approximately 20 microns. To the photosensitive member 3, the charging member in the form of a charging roller 4 is press-contacted with a predetermined force provided by a spring F. It rotates following the rotation of the photosensitive member 3. The photosensitive layer 3*c* may be made of amorphous silicon, selenium or the like.

The charging roller 4 comprises a metal core 4*a*, an inner layer 4*b* and an outer layer 4*c*. The core metal core 4*a* has a diameter of 6 mm and is supplied with a charging bias voltage from a voltage source E. The inner layer 4*b* is made of a rubber material such as EPDM mixed with carbon to provide a volume resistivity of $1\times10^3$ ohm.cm. It has a thickness of 3 mm. The outer layer 4*c* is made of epichrolohydrin rubber having a volume resistivity of $1.1\times10^8$ ohm.cm as the high resistance layer. The outer layer 4*c* may be covered with a coating of methoxymethyl nylon, since then, the rubber layer does not directly contact to the photosensitive member, and therefore, it is preferable from the standpoint that the softening agent is prevented from woozing from the rubber layer.

In this embodiment, a width d of the nip formed between the charging roller 4 and the photosensitive member 3 by the press-contact therebetween is 1 mm, and the length, measured along the axis, of the press-contact area is 220 mm. Under the high temperature and high humidity condition (32.5° C. and 85% RH), the volume resistivity and the electrostatic capacitance were measured at the nip, and the results were:

Volume resistivity of the charging roller: $5.1\times10^5$ ohm.cm

Electrostatic capacitance thereof: $2.6\times10^{-10}$ F

Volume resistivity of the photosensitive member: $5.1\times10^9$ ohm.cm

Electrostatic capacity thereof: $1.1\times10^{10}$ F

The total pressure provided by the spring F was 1.0 kg.

An AC source is designated by a reference E-1. It effects a constant current control (750 micro-amperes in this embodiment) through the charging roller 4 during at least a part of the period in which the charging roller 4 is in contact with such a region of the photosensitive member 3 surface as is going to be a non-image region. A voltage V1 (effective voltage) across the charging roller 4 is detected. Then, it effects a constant voltage control to the charging roller 4 with a voltage V2 obtained by multiplying the detected voltage V1 by a coefficient R (R=1.1 in this embodiment) during a period in which the charging roller 4 is in contact with such a region of the photosensitive member as is going to be an image region. The AC source E-1 supplies a voltage to the charging roller 4 so that the potential thereof periodically changes. The voltage across the charging roller 4 is not necessarily directly detected, but a voltage corresponding thereto may be detected in the circuit of the AC source E-1.

The above period in which the charging roller 4 is in contact with such a region of said photosensitive member as is going to be a non-image region may be a pre-rotation period (preparatory rotation of the photosensitive member 3) from the production of the image formation starting signal of the image forming apparatus to the start of the latent image formation on the photosensitive member, or the period in which the charging roller 4 is in contact with such a region of the photosensitive member as is going to be an interval (non-image region) between adjacent transfer materials in the case that plural images are formed continuously. The region of the image bearing member to which the charging roller 4 is contacted when the charging roller 4 is constant-voltage-controlled by the AC source E-1, is the image region, that is, the region in which the latent image is formed, as described hereinbefore. It is also the region in which the toner image is formed, and the region where the transfer material is contacted upon the image transfer operation.

A voltage source E-2 maintains a predetermined voltage (−750 V in this embodiment) of the DC component by a constant DC voltage control means H (constant DC voltage control), by which means the charge potential of the photosensitive member 3 is determined. The DC source E-2 effects the constant current control to the charging roller 4 at least when the voltage source E-1 effects the constant voltage control to the charging roller 4.

Figure 9:
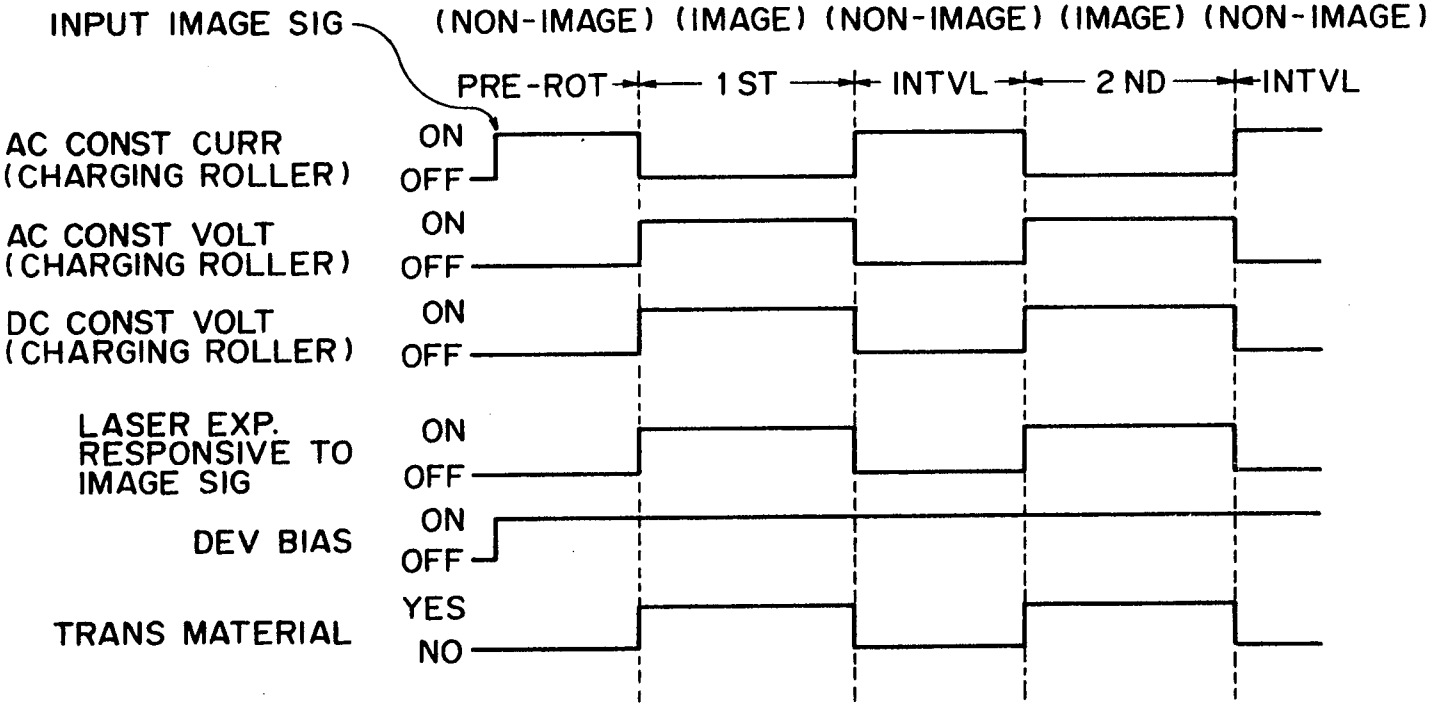
FIGS. 9 and 10 show an example of sequential operation of the image forming apparatus.

FIG. 9 shows an example of sequential operations of the image forming apparatus described hereinbefore. In this example, two image forming operations are continuously performed upon production of the image formation starting signal. In the FIG. 9 example, the same region of the rotating photosensitive member is subjected to the charging, image exposure, the development and the like operations. The time period in which a part of the photosensitive member moves from the charging position to the exposure position, or from the exposure position to the developing position. As will be understood, the image region on the photosensitive member, for example, is charged by the charging roller controlled both for the AC constant voltage and for the DC constant voltage; is exposed to the image by the laser beam; is subjected to the developing operation by the developing bias voltage applied to have a toner image; and is contacted to the transfer material, so that the toner image is transferred onto the transfer material.

In FIG. 9, the period in which the constant current control is effected to the charging roller 4 by the AC source may be at least a part of the above-described pre-rotation period and/or the sheets interval period.

The impedance of the charging roller (charging member) and the OPC photosensitive member (the member to be charged) at the nip changes depending on the ambient conditions, as follows:

| | High temperature High humidity (32° C., 85% RH) | Low temperature Low humidity (15° C., 10% RH) |
|---|---|---|
| Charging member | $3.9 \times 10^5$ ohm. | $1.3 \times 10^6$ ohm. |
| Member to be charged | $1.4 \times 10^6$ ohm. | $1.4 \times 10^6$ ohm. |

As will be understood, the impedance of the charged member hardly changes depending on the ambient conditions, whereas the charging member is small under the high temperature and high humidity condition as compared with the normal temperature and normal humidity condition (23° C., 64% RH), and is large under the low humidity and low temperature condition.

Therefore, under the low temperature and low humidity conditions, as contrasted to the high temperature and high humidity conditions, the effective AC voltage applied across the member to be charged by the AC voltage application to the charging member is significantly decreased. Therefore, it is desirable that the applied voltage is increased under the low temperature and low humidity conditions.

Figure 2:
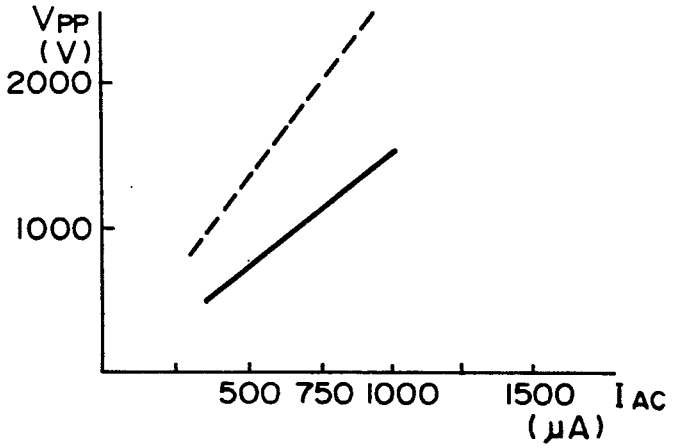
FIG. 2 is a graph showing a relation between an AC current and an AC voltage produced in the charging member thereby (peak-to-peak voltage).

FIG. 2 is a graph showing a relation between an AC current $I_{AC}$ through the charging roller and the peak-to-peak voltage Vpp of an AC voltage thereacross. The solid line and the broken lines correspond to the high temperature and high humidity condition and to the low temperature and low humidity condition, respectively.

As will be understood, when the constant current control is effected with 750 micro-amperes, the resulting peak-to-peak voltage is 1150 Vpp under the high temperature and high humidity condition and is 2000 Vpp under the low temperature and low humidity condition.

Figure 3:
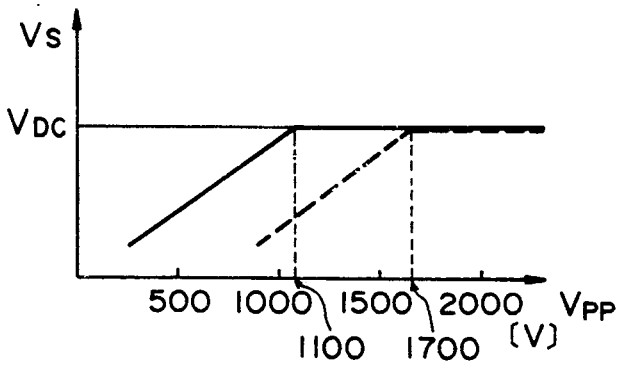
FIG. 3 is a graph showing a relation between a peak-to-peak voltage of an AC component of the voltage applied to the charging member and a surface potential of the charged member.
Figure 4:
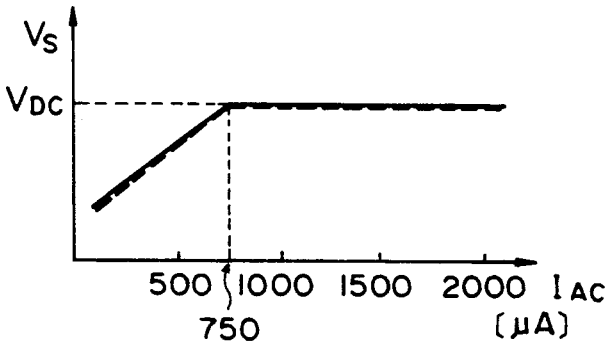
FIG. 4 is a graph showing a relation between an AC current and a surface potential of the charging member.

FIG. 3 shows the surface potential Vs of the charged member (OPC photosensitive member) when the peak-to-peak voltage Vpp of the alternating voltage to the charging member is changed.

In this case, the DC voltage Vdc is 750 V in this case.

As will be understood from FIG. 3, under the high temperature and high humidity condition (solid line), the surface potential of the charged member is stabilized so as to be uniform when the peak-to-peak voltage Vpp of the AC component is not less than 1100 V which is twice the charge starting voltage Vth (approx. 650 V). This is shown in FIG. 3 as the fact that even if the peak-to-peak voltage Vpp is increased, the surface potential of the photosensitive member 3 hardly changes (saturation). Here, the charge starting voltage Vth is a DC voltage applied to the charging member when the member to be charged starts to be charged only with a DC voltage applied to the contacting charging member. Since the impedance of the outer layer 4c of the charging roller is sufficiently small under the high temperature and high humidity condition as compared with the impedance of the member to be charged, that part of the AC component of the AC source E-1 which is applied across the charging member is negligibly small, and therefore, substantially all of the AC component is applied to the member to be charged.

Thus, as described in U.S. Pat. No. 4,851,960, the uniform charging is effected when the peak-to-peak voltage Vpp of the AC voltage and the charge starting voltage Vth satisfies $Vpp \geqq 2\,|Vth|$.

The reason the uniform charging is accomplished when the above requirement is satisfied, is considered as being that the vibratory electric field is formed between the charging member and the member to be charged so that not only the motion of the electric charge from the charging member to the member to be charged, but also the motion of the electric charge in the opposite direction is started, and therefore, even if the member locally receives electric charge to become locally high potential, it is decreased by the motion of the electric charge in the opposite direction, so that the potential is made uniform.

On the other hand, under the low temperature and low humidity condition, as shown by the broken line in FIG. 3, the impedance of the surface layer 4c is large, and therefore, the attenuation of the AC component is increased. In order to uniform and stabilize the surface potential of the charging member, it is considered as necessary to increase the voltage Vpp at a position where the photosensitive member surface potential is saturated despite the increase of the voltage Vpp, up to not less than 1700 V.

With this voltage level, the current exceeding the AC current of 1.3 milli-amperes flows since the impedance of the charging member decreases under the high temperature and high humidity condition, and therefore, a pin hole will be produced in the member to be charged.

In this embodiment, when the non-image region is in contact with the charging roller during the pre-rotation period and the sheet interval, a constant current AC control is effected (750 micro-amperes in this case) and an AC voltage (effective value) at this time is detected. When the charging roller 4 is in contact with the image region, the constant voltage control is effected with a DC biased AC containing a constant DC voltage (−750 V) and a constant AC voltage which is the detected voltage multiplied by 1.1 (coefficient). The detection of the AC voltage corresponds to the detection of the resistance of the charging roller under the ambient condition.

By doing so, under the high temperature and high humidity condition, an AC voltage of approximately 810 V (effective value) is detected, and when the charging roller 4 is in contact with the image region, the charging roller is constant-voltage-controlled with a DC biased AC voltage containing a constant DC voltage component of −750 V and a constant AC component of 891 V (effective value) which is 1.1 times 810 V.

The peak-to-peak voltage Vpp during the constant voltage control of the charging roller 4 is approximately 1260 V, and therefore, there is no liability of the production of non-uniform charging and production of a pin hole of the photosensitive member.

Under the low temperature and low humidity condition, approximately 1410 V (effective value) is detected, and when the charging roller 4 is in contact with the image region of the photosensitive member, the charging roller is constant-voltage-controlled with a DC biased AC voltage containing a constant DC voltage component of −750 V and a constant AC voltage component of 1550 V (effective value) which is 1410 multiplied by 1.1.

The peak-to-peak voltage Vpp during the constant voltage control effected to the charging roller 4 is approximately 2190 V, and therefore, the stabilized uniform charging operation is possible without the non-uniformity in the charging and without improper charging.

In the foregoing embodiment, the coefficient R has been described as 1.1, but the coefficient is not limited to this. It is preferably not less than 1, and is preferably even larger depending on the process conditions.

The target of the constant voltage control by the AC voltage source is determined during the constant current control by the AC voltage source. In the foregoing embodiment, the current during the constant current control through the charging roller is 750 micro-amperes. This voltage has been selected from the standpoint of stabilizing the surface potential of the photosensitive member irrespective of the frequency. However, it may be smaller than 750 V if the above-described coefficient R is selected to be larger. Particularly in the case of the regular development in which the non-image region is desirably free from the electric charge (the polarity of the charging for the formation of the latent image on the photosensitive member is opposite to the polarity of the electric charge of the developing toner), the coefficient R is preferably larger.

In place of the constant voltage control of the effective value of the AC voltage, it is preferable that the peak-to-peak voltage of the AC voltage is constant-voltage-controlled. If the waveform of the AC voltage is not deformed at all during the constant voltage control, they are the same, but if the waveform of the AC voltage involves deformation, the latter is preferable since in the former, it may be possible that the desired peak-to-peak voltage is not produced during the constant voltage control.

As described in the foregoing, according to the embodiment of the present invention, even if the impedance of the surface layer 4c of the charging roller 4 (charging member) under the high temperature and high humidity condition, the applied AC voltage decreased, and therefore, the production of the pin hole in the photosensitive member 3 (the member to be charged) can be minimized. In addition, even if the impedance of the surface layer 4c increases under the low temperature and low humidity condition, the applied voltage is increased, and therefore, even if the voltage is attenuated by the charging member, the charging power of the charging member can be maintained constant.

In the apparatus of the foregoing embodiment, the DC source E-2 is a constant voltage source. This will be described.

When a latent image pattern is formed on the photosensitive member 4 (the member to be charged), the memory by the electric charge corresponding to the pattern more or less remains on the photosensitive member, and the memory is removed by means of predischarger before the start of the latent image formation and after the image transfer of the previous image. However, with the repetitive use of the photosensitive member, the memory comes to a stage wherein it is not completely removable, with the result that it remains in the next charged portion.

If a constant current source is used for the DC source of the charging roller in this case, a constant current flows through the entire surface of the member to be charged, and therefore, the same amount of electric charge is applied, with the result of the non-uniform charging corresponding to the previous image pattern. Therefore, there is a liability of the image quality deterioration such as foggy background and the non-uniform density.

Figure 5:
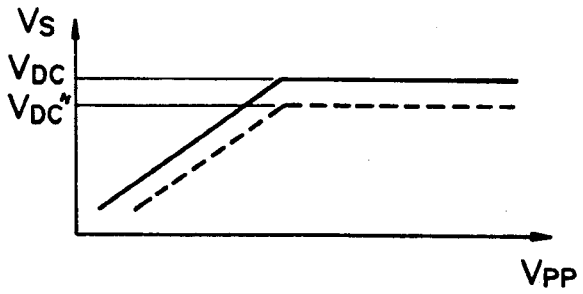
FIG. 5 is a graph showing a relation between a peak-to-peak voltage of an AC component of the voltage applied to the charging member and a surface potential of the member to be charged.

FIG. 5 shows a relation between the peak-to-peak voltage Vpp of the AC source connected with the charging member and the surface potential Vs of the OPC photosensitive member (member to be charged). As will be understood from this graph, when the DC voltage applied to the charging member is shifted from $V_{DC}$ to $V_{DC}'$, the saturation level (stabilized and uniform charging) is also shifted from $V_{DC}$ to $V_{DC}'$. Thus, the charge saturation level of the member to be charged is determined by the level of the DC voltage applied to the charging member.

Accordingly, it is understood that the DC source for supplying power to the charging member is preferably constant-voltage-controlled.

In the foregoing apparatus, when the charging roller 4 is in contact with the region of the photosensitive member which is going to be image area, the AC component of the voltage applied to the charging roller is constant-voltage-controlled. When the region comes to the transfer position, the transfer material is present there. It is possible that the width of nip between the charging roller 4 and the photosensitive member 3 may vary by mechanical vibration or the like. Even if it occurs, the charge is maintained uniform because the AC component Vpp is maintained constant.

As described in the foregoing, even if there is a potential memory on the surface of the photosensitive member due to the operation of the transfer charger at the sheet intervals or the memory due to the previous image, the charge is maintained uniform because the AC component of the voltage applied to the charging roller is constant-voltage-controlled.

It is further advantageous that the AC source E-1 shown in FIG. 1 is such that the detected voltage upon the constant current control through the charging roller is compared with a predetermined reference voltage, and the coefficient R is changed in accordance with the result of comparison, that is, the coefficient R is changed in accordance with the detected voltage.

For example, the reference level is taken as 1060 V (effective value), and when the detected voltage is not more than this level, the coefficient R is 1, and when it exceeds the reference level, the coefficient R is 1.5. When this has been done, the peak-to-peak voltage applied to the charging roller when the charging roller 4 is contact with the region of the photosensitive member which is going to be the image region, with approximately 1150 Vpp under the high temperature and high humidity condition, and is approximately 3000 Vpp under the low temperature and low humidity condition.

By doing so, while the peak-to-peak voltage of the AC component is suppressed under the high temperature and high humidity condition, while the high voltage can be applied under the low temperature and low humidity condition. Therefore, the tolerable range of the impedance change of the charging member due to the ambient condition change can be expanded, correspondingly.

Figure 6:
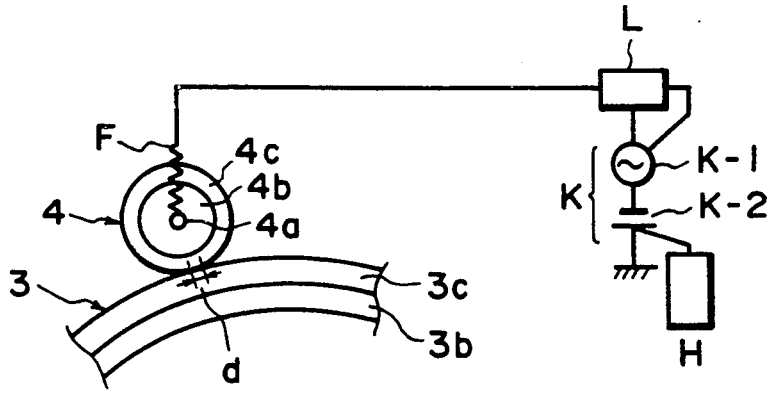
FIG. 6 is a side view of a charging device according to another embodiment of the present invention.

The charging device may have the structure as shown in FIG. 6 rather than in FIG. 1. The charging device of FIG. 6 will be described. In FIG. 6, the same reference numerals are assigned to the elements having the corresponding functions.

The charging member which is the charging roller 4 in this example is supplied with a charge bias from a voltage source K having an AC source K-1 and a DC source K-2.

The voltage source K-1 constant-voltage-controls the charging roller by an AC voltage having the peak-to-peak voltage of 1000 V, for example, when the charging roller 4 is in contact with such a portion of the photosensitive member as is going to be the non-image region (pre-rotation or sheet interval). Then, a detecting circuit L detects the AC current (effective value) and the current is converted to a voltage (Vpp) in accordance with a current-voltage conversion table shown in FIG. 7. When the charging roller 4 is in contact with such a region of the photosensitive member as is going to be the image region, the charging roller 4 is constant-AC-voltage controlled with the converted voltage (Vpp). The detection of the AC current by the detecting circuit L corresponds to the detection of the resistance of the charging roller under the current condition.

Figure 10:
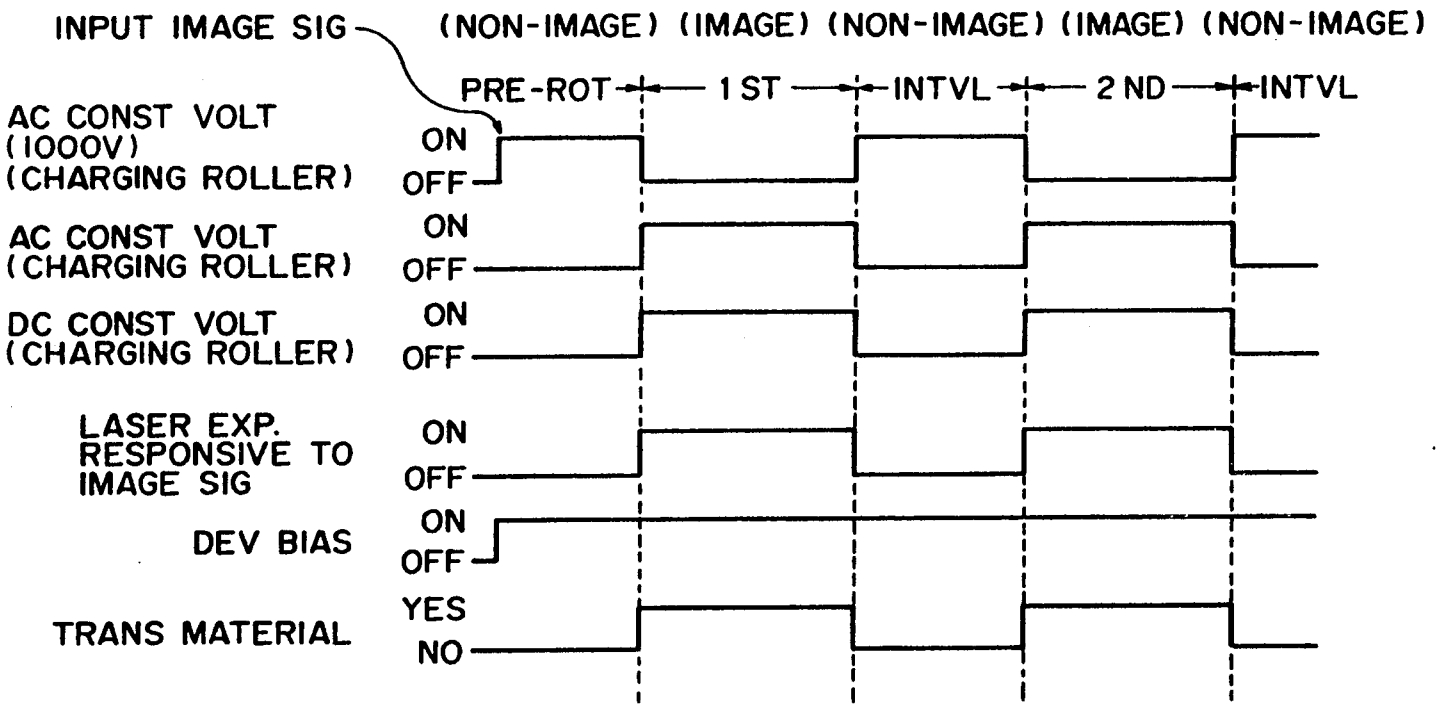

In the sequential operation of the charging device of this embodiment (FIG. 9), the charging roller is constant-voltage-controlled rather than constant-current-controlled, by the AC source. The other sequential operations are the same as the foregoing. The sequential operations are shown in FIG. 10. The constant voltage control operation with the peak-to-peak voltage of 1000 Vpp to the charging roller for the purpose of detecting the AC current by the detecting circuit L, may be carried out at least during a part of the period in which the charging roller is in contact with the portion of the photosensitive member which is going to be the non-image region.

The voltage source K-2 is a DC source controlled by a DC constant voltage control means H to provide a predetermined voltage level (−750 V, for example). By the control means H, the charge potential of the photosensitive member (the member to be charged) is determined.

Under the high temperature and high humidity condition, the charging roller is constant-voltage controlled with the voltage 1000 Vpp when the charging roller 4 is in contact with the portion of the photosensitive member which is going to be the non-image region. Then, the detecting circuit L detects an AC current of approximately 700 micro-amperes. Using the table of FIG. 7, an AC voltage level of 1200 Vpp is obtained. When the charging roller is in contact with the portion of the photosensitive member which is going to be the image region, the charging roller is constant-voltage controlled with the detected voltage of 1200 Vpp and is constant-voltage controlled with the constant DC voltage of −750 V, the AC and DC voltages being superposed.

Figure 7:
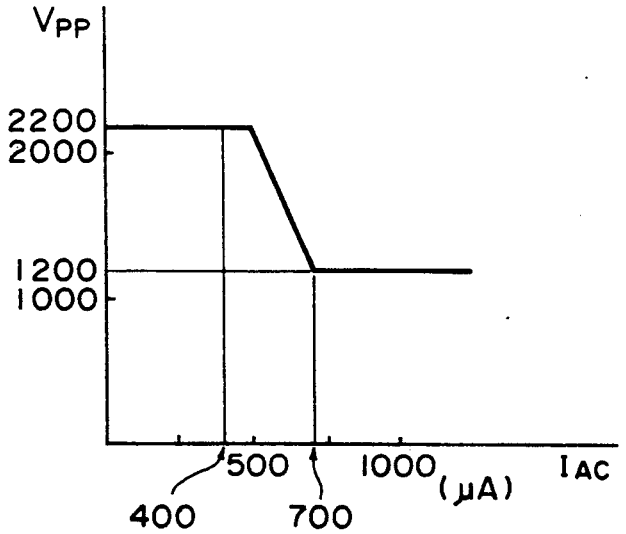
FIG. 7 shows a conversion table between a detected current and an applied voltage in the apparatus of FIG. 6.

On the other hand, under the low temperature and low humidity condition, when the charging roller is constant-voltage-controlled with the AC voltage of 1000 V, the detecting circuit L approximately 400 micro-amperes, and from the table of FIG. 7, a voltage of 2200 Vpp (AC voltage) is obtained. When the charging roller is in contact with such a region of the photosensitive member as going to be the image region, the charging roller is constant-voltage controlled with the AC voltage of 2200 Vpp, and is also constant-voltage-controlled with the DC voltage of −750 V, the DC voltage and the AC voltage being superposed.

In this embodiment, the charging roller is supplied under the high temperature and high humidity condition with 1200 Vpp which is not less than 1100 Vpp and which is not liable to produce a pin hole in the photosensitive member, and is supplied under the low temperature and low humidity condition with 2200 Vpp which is not less than 2000 Vpp and which is not liable to produce improper charging. Therefore, the good charging properties can be provided under all conditions.

By changing the conversion table between the detected current and the voltage to be applied, shown in FIG. 7, may be changed so that a lower voltage is applied under the high temperature and high humidity condition, and a higher voltage is applied under the low temperature and low humidity condition.

In any of the above-described embodiments, the upper and/or the lower limit may be imposed to the AC current or the AC voltage through the charging roller 4 (charging member), so that the production of the pin hole in the member to be charged under the high temperature and high humidity condition and the improper charging under the low temperature and low humidity condition, can be further assuredly prevented. One or more of the upper and lower limits of the AC current and the AC voltage, may be controlled, as the case may be.

The same advantageous effect can be obtained by applying the voltage to the charging member during the warming-up period for the heat fixing device (when the charging member is in contact with the non-image region of the photosensitive member) and by adding a predetermined DC voltage to the AC voltage which is determined during that period.

As for the waveform of the AC voltage, a sine wave, triangular wave or rectangular wave is usable.

In the foregoing the charging member has been described as being in the form of a roller, but it may be in the form of a blade.

In place of the above-described AC voltage source, a DC source may be used which is periodically rendered on and off to apply a rectangular wave voltage to the charging member. At this time, the waveform of the applied voltage is, in effect, an AC voltage described hereinbefore. In this case, when the charging member is in contact with the region of the photosensitive member which is going to be the image region, the peak-to-peak voltage is maintained constant to effect the constant voltage control for the charging member by the DC source.

In the foregoing, the level of the constant voltage of the constant voltage control which is effected by the AC source when the charging member is in contact with the region of the photosensitive member which is going to be the image region, is determined when the charging member is in contact with the portion of the photosensitive member which is going to be the non-image area, as will be understood from FIGS. 9 and 10. However, the determination may be made when the charging member is in contact with such a region of the photosensitive member as is going to be the image region. In this case, the image formed in the region is liable to be not good due to the non-uniform charging. Therefore, it is a possible modification that the image forming apparatus produces a number of prints, the number being more than the set number by one.

As described in the foregoing, according to the present invention, the charging member is constant- current- or constant-voltage-controlled, and the voltage or the current at this time is detected. By doing so, the impedance of the charging member which is variable in accordance with the ambient conditions can be detected in effect. Therefore, irrespective of the variation in the ambient conditions, the charging operation is stabilized and uniform at all times.

While the invention has been described with reference to the structures disclosed herein, it is not confined to the details set forth and this application is intended to cover such modifications or changes as may come within the purposes of the improvements or the scope of the following claims.

What is claimed is:

1. A charging device, comprising:

a content member contactable to a member to be charged; and voltage applying means for applying to said contact member a voltage having a voltage level which periodically changes, to charge said member to be charged;

wherein said voltage applying means constant-voltage-controls said contact member in a first period and constant-current-controls said contact member in a second period, wherein a constant voltage level V2 in the first period is determined in the second period.

2. A device according to claim 1, wherein said voltage is in the form of a sine wave voltage.

3. A device according to claim 1, wherein said constant voltage level is determined on the basis of a voltage of said contact member in the second period.

4. A device according to claim 3, wherein the constant voltage level V2 is a voltage V1 multiplied by a coefficient R ($R \geqq 1$), wherein V1 is a voltage of said contact member in the second period.

5. A device according to claim 4, wherein the coefficient R is changed in accordance with the voltage V1.

6. A device according to claim 1, further comprising a DC voltage applying means for applying a DC voltage to said contact member, wherein said DC voltage applying means constant-voltage-controls said contact member in the first period.

7. A device according to claim 1, wherein said contact member comprises a roller.

8. A device according to claim 1, wherein the voltage level or a current through said contact member is limited to at most a predetermined value.

9. A device according to claim 1 or 8, wherein the voltage level or a current flowing through said contact member is limited to at least a predetermined value.

10. A charging device, comprising:

a contact member contactable to a member to be charged;

a voltage applying means for applying to said contact member a voltage having a voltage level which changes periodically;

wherein said voltage applying means constant-voltage-controls said contact member with a first voltage in a first period and constant-voltage-controls said contact member with a second voltage in a second period, wherein the first voltage is determined on the basis of a current flowing through said contact member in the second period.

11. A device according to claim 10, wherein the voltage is in the form of a sine wave voltage.

12. A device according to claim 10, further comprising a DC voltage applying means for applying a DC voltage to said contact member, wherein said DC voltage applying means constant-voltage-controls said contact member in the first period.

13. A device according to claim 10, wherein said contact member comprises a roller.

14. A device according to claim 10, wherein the voltage level or a current through said contact member is limited to at most a predetermined value.

15. A device according to claim 10 or 14, wherein the voltage level or a current flowing through said contact member is limited to at least a predetermined value.

16. An image forming apparatus, comprising:

a movable image bearing member;

a charging device including a contact member contactable to a member to be charged; and voltage applying means for applying to said contact member a voltage having a voltage level which periodically changes, to charge said member to be charged, wherein said voltage applying means constant-voltage-controls said contact member in a first period and constant-current-controls said contact member in a second period, and wherein a constant voltage level V2 in the first period is determined in the second period.

17. An apparatus according to claim 16, wherein the voltage is in the form of a sine wave voltage.

18. An apparatus according to claim 16, wherein the constant voltage level is determined on the basis of a voltage of said contact member in the second period.

19. An apparatus according to claim 18, wherein the constant voltage level V2 is a voltage V1 multiplied by a coefficient R ($R \geqq 1$), wherein V1 is a voltage of said contact member in the second period.

20. An apparatus according to claim 19, wherein the coefficient R is changed in accordance with the voltage V1.

21. An apparatus according to claim 16, further comprising a DC voltage applying means for applying a DC voltage to said contact member, wherein said DC voltage applying means constant-voltage-controls said contact member in the first period.

22. An apparatus according to claim 16, wherein said contact member comprises a roller.

23. An apparatus according to claim 16, wherein the voltage level or a current through said contact member is limited to at most a predetermined value.

24. An apparatus according to claim 16 or 23, wherein the voltage level or a current flowing through said contact member is limited to be at least a predetermined value.

25. An apparatus according to claim 16, wherein in the first period said contact member is in contact with such a region of said image bearing member as is going to be an image region.

26. An apparatus according to claim 16 or 25, wherein in the second period, said contact member is in contact with such a region of said image bearing member as is going to be a non-image region.

27. An apparatus according to claim 25, wherein the image region is a region of said image bearing member in which a latent image is formed.

28. An apparatus according to claim 26, wherein the non-image region is a region of said image bearing member in which a latent image is not formed.

29. An apparatus according to claim 25, wherein the image region is a region of said image bearing member where a transfer material is in contact with said image bearing member when an image is transferred from said image bearing member onto the transfer material.

30. An apparatus to claim 26, wherein the non-image region is a region of said image bearing member where a transfer material is not in contact with said image bearing member when an image is transferred from said image bearing member onto the transfer material.

31. An apparatus according to claim 16, wherein in the second period, said image forming apparatus is in a preparatory state for start of image formation.

32. An apparatus according to claim 16, wherein when plural images are continuously formed, the second period is a period in which said contact member is in contact with such a region of said image bearing member as is going to be a region corresponding to an interval between adjacent sheets which are going to receive the images.

33. An image forming apparatus, comprising:

a movable image bearing member;

a charging device, including a contact member contactable to a member to be charged; and a voltage applying means for applying to said contact member a voltage having a voltage level which changes periodically, wherein said voltage applying means constant-voltage-controls said contact member with a first voltage in a first period and constant-voltage-controls said contact member with a second voltage in a second period, wherein the first voltage is determined on the basis of a current flowing through said contact member in the second period.

34. An apparatus according to claim 33, wherein the voltage is in the form of a sine wave voltage.

35. An apparatus according to claim 33, further comprises a DC voltage applying means for applying a DC voltage to said contact member, wherein said DC voltage applying means constant-voltage-controls said contact member in the first period.

36. An apparatus according to claim 33, wherein said contact member comprises a roller.

37. An apparatus according to claim 33, wherein the voltage level or a current through said contact member is limited to at most a predetermined value.

38. An apparatus according to claim 33 or 37, wherein the voltage level or a current flowing through said contact member is limited to at least a predetermined value.

39. An apparatus according to claim 33, wherein in the first period said contact member is in contact with such a region of said image bearing member as is going to be an image region.

40. An apparatus according to claim 33 or 39, wherein in the second period, said contact member is in contact with such a region of said image bearing member as is going to be a non-image region.

41. An apparatus according to claim 39, wherein the image region is a region of said image bearing member in which a latent image is formed.

42. An apparatus according to claim 40, wherein the non-image region is a region of said image bearing member in which a latent image is not formed.

43. An apparatus according to claim 39, wherein the image region is a region of said image bearing member where a transfer material is in contact with said image bearing member when an image is transferred from said image bearing member onto the transfer material.

44. An apparatus according to claim 40, wherein the non-image region is a region of said image bearing member where a transfer material is not in contact with said image bearing member when an image is transferred from said image bearing member onto the transfer material.

45. An apparatus according to claim 33, wherein in the second period, said image forming apparatus is in a preparatory state for start of image formation.

46. An apparatus according to claim 33, wherein when plural images are continuously formed, the second period is a period in which said contact member is in contact with such a region of said image bearing member as is going to be a region corresponding to an interval between adjacent sheets which are going to receive the images.

47. An apparatus according to claim 16 or 33, further comprising a process unit detachably mountable thereto, said process unit containing said image bearing member and said charging device.

48. An image forming apparatus, comprising:

image forming means for forming an image on a recording material under an image forming condition, said image forming means including an image bearing member, a charging member for charging the image bearing member, and a power source for supplying said charging member with electric current having a periodically changing current level;

first control means for controlling said power source to supply a constant current; and second control means for controlling the image forming condition on the basis of a voltage provided when said first control means is operated.

49. An apparatus according to claim 48, wherein said charging member is contactable to said image bearing member.

50. An apparatus according to claim 48 or 49, wherein said second control means includes constant voltage control means for supplying a constant voltage level to said charging member, and the constant voltage level is determined on the basis of a voltage produced when said first control means is operated.

51. An apparatus according to claim 50, wherein the constant voltage level is the same as the voltage produced when said first control means is operated.

52. An apparatus according to claim 51, further comprising DC voltage applying means for applying a DC voltage to said charging member when said constant voltage control means supplies the voltage.

53. An apparatus according to claim 49, wherein said charging member comprises a roller.

54. An apparatus according to claim 48, wherein a portion of said image bearing member which is at a position of said charging member during operation of said first control means is the portion which is going to be the non-image area.

55. An apparatus according to claim 54, wherein the non-image area of said image bearing member corresponds to a portion which does not contact the transfer material in an image transfer operation.

56. An apparatus according to claim 49, further comprising a process unit detachably mountable thereto, said process unit containing said image bearing member and said charging device.

57. An image forming apparatus, comprising:

image forming means for forming an image on a recording material under an image forming condition, said image forming means including an image bearing member, a charging member for charging the image bearing member, and a power source for supplying the charging member with an electric voltage having a periodically changing voltage level;

first control means for controlling the power source to supply a constant voltage; and second control means for controlling the image forming condition of said image forming means on the basis of an electric current produced when said first control means is operated.

58. An apparatus according to claim 57, wherein said charging member is connectable to said image bearing member.

59. An apparatus according to claim 57 or 58, wherein said second control means comprises a constant voltage control means for supplying to said charging member a constant voltage level which is determined on the basis of the current produced when said first control means is operated.

60. An apparatus according to claim 59, wherein the constant voltage level is the same as the voltage produced when said first control means is operated.

61. An apparatus according to claim 60, further comprising DC voltage applying means for applying a DC voltage to said charging member when said second control means is operated.

62. An apparatus according to claim 58, wherein said charging member comprises a roller.

63. An apparatus according to claim 57, wherein a portion of said image bearing member which is at the position of said charging member during operation of said first control means is the portion which is going to be the non-image area.

64. An apparatus according to claim 63, wherein the non-image area of said image bearing member corresponds to a portion which does not contact the transfer material in an image transfer operation.

65. An apparatus according to claim 57, further comprising a process unit detachably mountable thereto, said process unit containing said image bearing member and said charging device.

* * * * *

UNITED STATES PATENT AND TRADEMARK OFFICE

CERTIFICATE OF CORRECTION

PATENT NO. : 5,144,368

DATED : September 1, 1992

INVENTOR(S) : YUKIHIRO OHZEKI, ET AL.

It is certified that error appears in the above-identified patent and that said Letters Patent is hereby corrected as shown below:

COLUMN 1

Line 67, "ble" should read --bly--.

COLUMN 3

Line 66, "cleaner 2" should read --cleaner 2a--.

COLUMN 4

Line 26, "epichrolohydrin" should read --epichlorohydrine--.

COLUMN 7

Line 6, "as" should be deleted.

COLUMN 8

Line 23, "de-" should read --is de---.

UNITED STATES PATENT AND TRADEMARK OFFICE

CERTIFICATE OF CORRECTION

PATENT NO. : 5,144,368

DATED : September 1, 1992

INVENTOR(S) : YUKIHIRO OHZEKI, ET AL.

It is certified that error appears in the above-identified patent and that said Letters Patent is hereby corrected as shown below:

COLUMN 9

Line 35, "is" should read --is in--.

COLUMN 10

Line 42, "L" should read --L detects--.

COLUMN 14

Line 20, "prises" should read --prising--.

Signed and Sealed this

Nineteenth Day of October, 1993

Bruce Lehman

*Attest:*

BRUCE LEHMAN

*Attesting Officer*

*Commissioner of Patents and Trademarks*